US010112092B2

(12) United States Patent
Dooley

(10) Patent No.: US 10,112,092 B2
(45) Date of Patent: Oct. 30, 2018

(54) PIVOTING SOCCER GOAL AND GAME

(71) Applicant: Brian Joseph Dooley, Mission, KS (US)

(72) Inventor: Brian Joseph Dooley, Mission, KS (US)

( * ) Notice: Subject to any disclaimer, the term of this patent is extended or adjusted under 35 U.S.C. 154(b) by 0 days.

(21) Appl. No.: 15/661,148

(22) Filed: Jul. 27, 2017

(65) Prior Publication Data

US 2017/0333769 A1 Nov. 23, 2017

(51) Int. Cl.

| | |
|---|---|
| ***A63B 69/00*** | (2006.01) |
| ***A63B 63/06*** | (2006.01) |
| ***A63B 63/00*** | (2006.01) |
| ***A63B 67/00*** | (2006.01) |

(52) U.S. Cl.

CPC ..... *A63B 63/06* (2013.01); *A63B 63/004* (2013.01); *A63B 67/002* (2013.01); *A63B 2063/065* (2013.01); *A63B 2210/50* (2013.01); *A63B 2243/0025* (2013.01)

(58) Field of Classification Search

CPC ..... A63B 63/06; A63B 63/004; A63B 67/002; A63B 2063/065; A63B 2210/50

USPC ..... 473/422, 446, 438, 447, 433, 439, 454, 473/476–478, 479

See application file for complete search history.

(56) References Cited

U.S. PATENT DOCUMENTS

| | | | | |
|---|---|---|---|---|
| 4,463,951 | A | 8/1984 | Kumasaka et al. | |
| 4,558,862 | A | 12/1985 | Kelly | |
| 5,558,338 | A * | 9/1996 | Taub | A63B 69/0071 473/435 |
| 5,911,214 | A * | 6/1999 | Andrews | A63B 69/408 124/16 |
| 6,022,283 | A | 2/2000 | Schindler et al. | |
| 6,190,272 | B1 | 2/2001 | Bernard | |
| 6,200,234 | B1 | 3/2001 | Hannon | |
| 6,579,197 | B2 | 6/2003 | Benoit | |
| 6,974,390 | B2 | 12/2005 | Shioda | |
| 7,648,431 | B1 * | 1/2010 | Kinkead | A63B 63/00 473/422 |
| 7,780,552 | B2 | 8/2010 | Rhee | |
| D704,285 | S | 5/2014 | Zucca et al. | |
| 8,888,615 | B2 | 11/2014 | Hulbert et al. | |
| 8,968,124 | B2 * | 3/2015 | Query, Jr. | A63B 63/004 473/478 |
| D729,328 | S | 5/2015 | Romley | |
| 9,526,961 | B2 * | 12/2016 | Wallace | A63B 63/004 473/476 |
| 2006/0199674 | A1 * | 9/2006 | Rogers | A63B 63/004 473/446 |
| 2008/0058134 | A1 | 3/2008 | Yang | |
| 2009/0291782 | A1 | 11/2009 | Hinn | |
| 2015/0011340 | A1 * | 1/2015 | Hulbert | A63B 63/008 473/477 |
| 2016/0310817 | A1 * | 10/2016 | Yeager | A63B 69/406 473/431 |

* cited by examiner

*Primary Examiner* — Mitra Aryanpour
(74) *Attorney, Agent, or Firm* — Kenneth W. Iles

(57) ABSTRACT

A pivoting soccer goal mounted on a turntable can rotate so that a ball directed at the goal from nearly any angle will rotate the goal so that the ball will go into the goal. The goal can be seated in a standard golf cup and so can be used on a golf course. In another embodiment, the pivoting soccer goal can be mounted on a mat and set on any suitable field without the need for any holes in the ground.

9 Claims, 6 Drawing Sheets

PIVOTING SOCCER GOAL AND GAME

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus and process for playing variants of traditional soccer. More particularly, the present invention is related to a goal that can be seated in a conventional golf hole cup or on the ground and games that can be played using the goal.

DESCRIPTION OF THE RELATED ART INCLUDING INFORMATION DISCLOSED UNDER 37 C.F.R. 1.97 and 1.98

Soccer, or football, is becoming increasingly popular in the United States, while the game of golf is in decline. Consequently, more venues for playing soccer or a soccer-like game involving a net and a soccer ball and a game utilizing a golf course are both desirable.

A number of soccer-like games that utilize a golf course have been invented. For example, Hannon, U.S. Pat. No. 6,200,234 B1, discloses a Portable Soccer Golf Game that includes a soccer goal in the form of a portable net that is essentially a reproduction of a standard soccer goal, but having a pair of folding legs that are connected by a bar at ground level, which pivot away from a main vertical frame to form the rear, or ball catching, portion of a soccer goal. A spike on each of the two front feet of the goal are pressed into the ground. A number of such goals are set up along a course, such as a golf course and a number of different types of games can be played using this portable net. In soccer, of course, the ball must be kicked into the mouth of a large stationery net, which is also the case with Hannon. This arrangement ignores that a golf course or similar layout is different from a soccer field in that the goals of a soccer field are placed near the end lines of the field and balls that miss the goal typically go out of bounds, where they are stopped by a wall, referee or the like and then returned to the field of play. There are no set boundaries on an open course, such as a golf course. In a golf-like unbounded layout, when the kicked ball misses the goal of Hannon, the player must kick the ball around until a kick toward the goal is again possible. This is completely unlike soccer. In the game of golf, a player may hit the ball toward the cup regardless of the relative positions of the cup and the ball. That is, the player can hit the ball toward the cup regardless of whether he is on the front or back of the green or in any other position relative to the cup. The fixed goal of Hannon deprives the player of this advantage of golf.

Hinn, Published Patent Application US 2009/0291782 A1, discloses another soccer-like game intended to be played on a golf course. Hinn uses a goal consisting of a relatively tall thin goal that can be placed into a conventional golf cup or supported by a rubber base. A player makes a goal by kicking the ball against the stanchion, or goal, activating lights and sounds and causing a motor to rotate a visual display. This system allows the player to approach the goal from any direction, but provides a very small target, which is quite different from the very large target of conventional soccer. Kicking a soccer ball does not match the precision possible when striking a golf ball with a putter, so players may become frustrated with how difficult it is to hit the goal. In golf, successive shots are typically hit with less force and more control as the ball gets closer to the cup. In conventional soccer this is rarely if ever the case, as the goal is to kick the ball past a goalie who is trying to prevent the score and so the offensive player typically wants to kick the ball has hard as possible. Hinn, however, encourages the soccer player to kick the ball as a golfer plays a golf ball. Otherwise, the ball is very likely to go flying far past the goal, leading to frustration.

In another soccer-like game, Bernard, U.S. Pat. No. 6,190,272 B1, provides a conventionally constructed soccer goal, but of smaller size, with a minor obstacle in front of the mouth of the goal, which is a curved ramp that the ball must pass over before entering the goal. A number of these goals are spaced apart along a course. Of course, the ball can enter the goal only through the open mouth of the goal and so must always be approached from in front of the goal. In another version, a conical mat has a large diameter vertical bore, or tube, into which the ball must fall in order to record a goal. This goal allows a player to approach the goal from any direction, but requires that the player kick the ball into the hole, again making soccer more like golf and contrary to its nature. It also requires the player to kick the ball up a fairly steep slope that is very close to the hole, which is a dramatic departure from soccer, in which the bottom of the goal is the ground that the goal sits on.

In a conventional soccer golf game, a number of large diameter holes, typically about 75 cm (30 in) in diameter and about 30 cm (1 foot) deep are dug into a conventional golf course at locations roughly corresponding to the normal golf holes, but at some distance from the green. The object of the game is to count the number of kicks required to place the ball in each hole along the course, with the player having the lowest total score being the winner. When the course is not being used to play this soccer golf game, the soccer golf holes are covered plastic covers, which may be weighted down or staked to the ground. Many golf courses do not wish to dig holes on their courses; the play of a golf ball will become dramatically different it the ball hits one of these soccer golf hold covers. Workers or players may forget to replace the covers once a game has been completed or vandals may take them, all leading to physical hazards and unnecessary liability exposure.

Therefore, it would be desirable to provide a soccer golf goal that would provide a goal resembling a conventional soccer goal; that provides the golfing advantage of being approachable from any direction; and that does not disturb the grounds of a golf course. It would also be desirable to provide such a goal that can be set up on the ground without any need for a golf hole to provide a base. Such goals can be set down directly on the ground for practice or for fun. It would also be desirable to provide one or more games that can be played utilizing such goals.

BRIEF SUMMARY OF THE INVENTION

Accordingly, it is a primary object of the present invention to provide a soccer goal resembling a conventional soccer goal.

It is an other object of the present invention to provide the golfing advantage of being able to approach the soccer goal from any direction.

It is an other object of the present invention to provide a soccer goal that does not disturb the grounds of a golf course.

It is another object of the present invention to provide a soccer goal resembling a conventional soccer goal that can be mounted in a conventional golf cup.

It is another object of the present invention to provide a soccer goal resembling a conventional soccer goal that can be mounted in a conventional golf cup.

It is another object of the present invention to provide soccer-like games that can be played using the embodiments of the soccer goal described herein.

To achieve these objects of the present invention, a reduced size soccer goal that pivots when struck by a ball and then presents the mouth of the goal to the ball is disclosed. In a first embodiment, the soccer goal is provided with a pivoting base that fits into a conventional golf cup. In a second embodiment, the soccer goal can be placed on a base that sits directly on the ground. In either embodiment, the nature of the soccer player to kick the ball hard is preserved as the goal is large enough that great precision is not required by the striker. At the same time, the characteristic of golf that the hole, or in this case, the goal, may be approached from any direction, is imparted to soccer. This allows the primary attributes of soccer to be preserved while expanding the nature of the play to accommodate new games and increase the game possibilities associated with soccer.

A soccer goal according to the present invention includes a modified soccer goal attached to a turntable or the like with a hub attached to the lower side of the turntable. The hub fits into a standard golf cup. By this design, the goal can pivot or rotate when struck by a soccer ball. The frame of the goal is planar and the net is draped over and fastened to the frame, so a ball can enter the net from any direction. The frame of the goal includes a horizontal bar that is located slightly above ground level so that it is free to pivot about its midpoint, where the rotating hub is fixed to it, and an upright arm on each end of the bar, which have a straight parallel portion to some distance above the horizontal bar and then taper inwardly to meet at a point directly above the rotating hub. The horizontal bar and the two arms form a frame. A net is loosely attached to the frame so that the net will flow outwardly from the frame to catch a ball. The frame and net are very much smaller than a standard soccer goal so that they are easily portable and so that they can be supported in a golf cup. A pennant can be attached to a staff rising from the top of the frame to make the goal easier to locate and, if desired, to identify the goal as being that of a particular team. The rotating hub is placed directly into a conventional golf cup.

In an alternative embodiment, of a soccer goal according to the present invention uses the same goal as the first embodiment, but does not have a depending hub. Instead the goal is fixed to a large base, preferably a flexible circular base includes by a turntable, with the lower turntable member fastened to the base, or mat, and the upper turntable mounted onto the base of the goal portion itself and to the lower turntable member. A flexible skirt can be attached to the perimeter of the large ground-engaging base to provide a smooth approach to the goal when the entire goal is placed on uneven terrain. This embodiment can be used on any suitable open area, from a backyard to an open field, or a golf course, without having to use or dig any holes.

In either embodiment, the goal will turn to receive a ball that hits it, regardless of the orientation of the net to the ball or the player. This makes it easier to make a goal and allows the player to approach the back of the net the same as he approaches the front of the net, providing a novel soccer-like experience and encouraging hard kicks.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
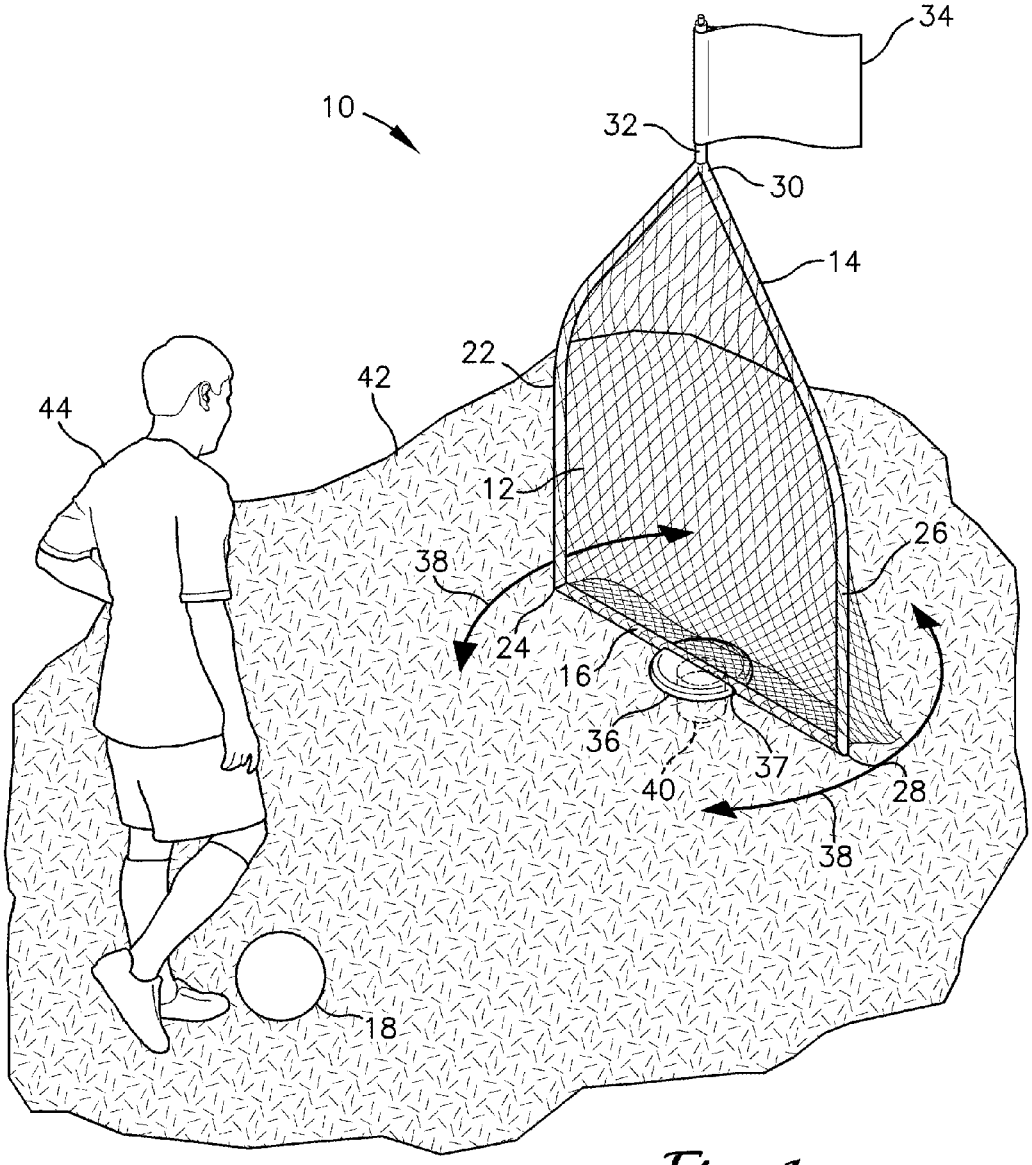
FIG. 1 is an isometric view of a soccer goal according to the present invention shown in use on golf course.

Referring to FIG. 1, a pivoting soccer goal, or soccer goal 10 according to the present invention includes a net 12 fastened to the perimeter of a frame 14 by any conventional means, which, as shown, includes a hem that the members of the frame 14 are threaded through. The frame 14, which is an upright frame when installed for use, includes a horizontal bar 16, which is held a short distance above the ground, for example, 0.6 cm-1.0 cm (1.5-2.5 inches). Some clearance above the ground is required so that the soccer goal 10 can pivot freely, but the clearance should be minimal to provide as little an obstacle to the soccer ball 18 as feasible. In any event, the frame 14 is preferably made from rods or tubes, with certain plastics being suitable, as well as aluminum and the like and these may be covered with clothe, tool dip or the like, so any soccer ball 18 that strikes any surface of the frame 14 will most likely enter the net 12, which catches and retains the soccer ball 18 because the net 12 is fairly loose and sags with just enough slack so that a soccer ball 18 is kicked into it, the ball is caught and cradled in the slack net and will not bounce out or fall out of the net 12. The frame 14 consists of the horizontal bar or member 16, which is a horizontally disposed bottom member, an upstanding left arm 22 and an upstanding right arm 26, connected as follows. The upstanding left arm 22 is fastened to the left end 24 of the horizontal bar 16 and an upstanding right arm 26 is fastened to the right end 28 of the horizontal bar 16. At a point about one-third of the distance from the horizontal bar 16 to the top 30 of the soccer goal 10, the left and right arms 26, 28, taper inwardly toward each other uniformly until the upper ends of the left and right arms 26, 28 meet at the top 30 of the soccer goal 10, where they are fastened together by any conventional means. This taper can be achieved from straight rods or the like by bending the members as desired. A flag pole 32 projects upwardly from the top 30 of the soccer goal 10 and carries a pennant 34, which can be used to help players locate the soccer goal 10 from a distance or to identify the soccer goal 10 of being that of a particular team. The entire frame 14 lies in a single plane. The frame 14 may be made in any desirable shape or size. For example, it may have square or rectangular perimeter or may have rearwardly projecting horizontal bars attached to the ends 24, 28 of the horizontal bar to provide greater depth to the net 12. This has been found to be unnecessary, but some players may prefer a net 12 that more closely resembles a conventional soccer goal. In any case, the soccer goal 10 is preferably is small enough and light enough that one person can handle it easily and can carry and install it and several to many of the soccer goals 10 will fit into a conventional car, light truck or the like.

A base 36 is fastened to a bottom surface of the horizontal bar 16 in the middle of the length of the horizontal bar 16. The base 36 includes a recessed portion, that is, a grove 37 and the center portion of the horizontal bar 16, as shown by its location in FIG. 1, for example, is seated into the groove 37 in a firm manner and may be secured by screws or the like through the two members. The groove 37 is deep enough so that when the horizontal bar 16 is seated in the groove 37, the horizontal bar is at the desired height above the ground 42. To facilitate low ground clearance, the horizontal bar 16 may be made from flat stock metal or plastic, or the center portion may be made of flat stock with rod or tubes fastened to each of a flat stock portion. The length of the recessed portion, or groove 37 is the same as the length of the base 36. In the preferred case of a circular base 36, the length of the base 36 is its diameter. Other methods of fastening the horizontal bar 16 to the base 36 can be easily designed, such as rivets, bolts, and the like. The base 16 includes a turntable mechanism that allows the soccer goal 10 to pivot throughout a full range of 360° in either direction as shown by the double-headed arrows 38 and a depending extension hub (both shown in FIG. 2) that fits into a conventional golf cup 40 that is set into the ground 46. Conventional golf cups have a depth of either 10 cm (4 inches) or 15 cm (6 inches). The soccer goal 10 will fit snugly into either and provide a stable installation of the soccer goal. In use, a player 44 kicks the soccer ball 18 repeatedly to move the ball closer to the soccer goal 10, with the objective being to kick the soccer ball 18 into the net 12. When the soccer ball 18 strikes any part of the soccer goal 10, the soccer goal 10 will pivot far enough to present the open face of the soccer goal 10 that is formed by the shape of the frame 14 to the soccer ball 18, which is then received into, and caught by, the net 12, thereby scoring a goal. This operation fails to occur only in the unlikely event that the soccer ball 18 strikes the upstanding portions of the frame 14 with more than half of the diameter of the soccer ball 18 outside the perimeter of the frame 14 or with a fast spin that might rotate the soccer ball 18 away from the soccer goal 10. It has been established, however, that in virtually every case the soccer goal 10 will rotate to receive the soccer ball 18. Therefore there is no actual front or rear of the soccer goal 10, except that the direction from which the player 44 initially approaches the soccer goal 10 may be considered the front of the soccer goal 10 at that time. If a kicked soccer ball 18 overshoots the soccer goal 10, however, the player 44 can still kick the soccer ball 18 toward the soccer goal 10 regardless of where the player 44 is on the field and regardless of his orientation to the soccer goal 10 and the soccer ball 18 will enter the soccer goal 10 and be caught by the net 12 if the soccer ball 18 strikes the soccer goal 10.

Figure 2:
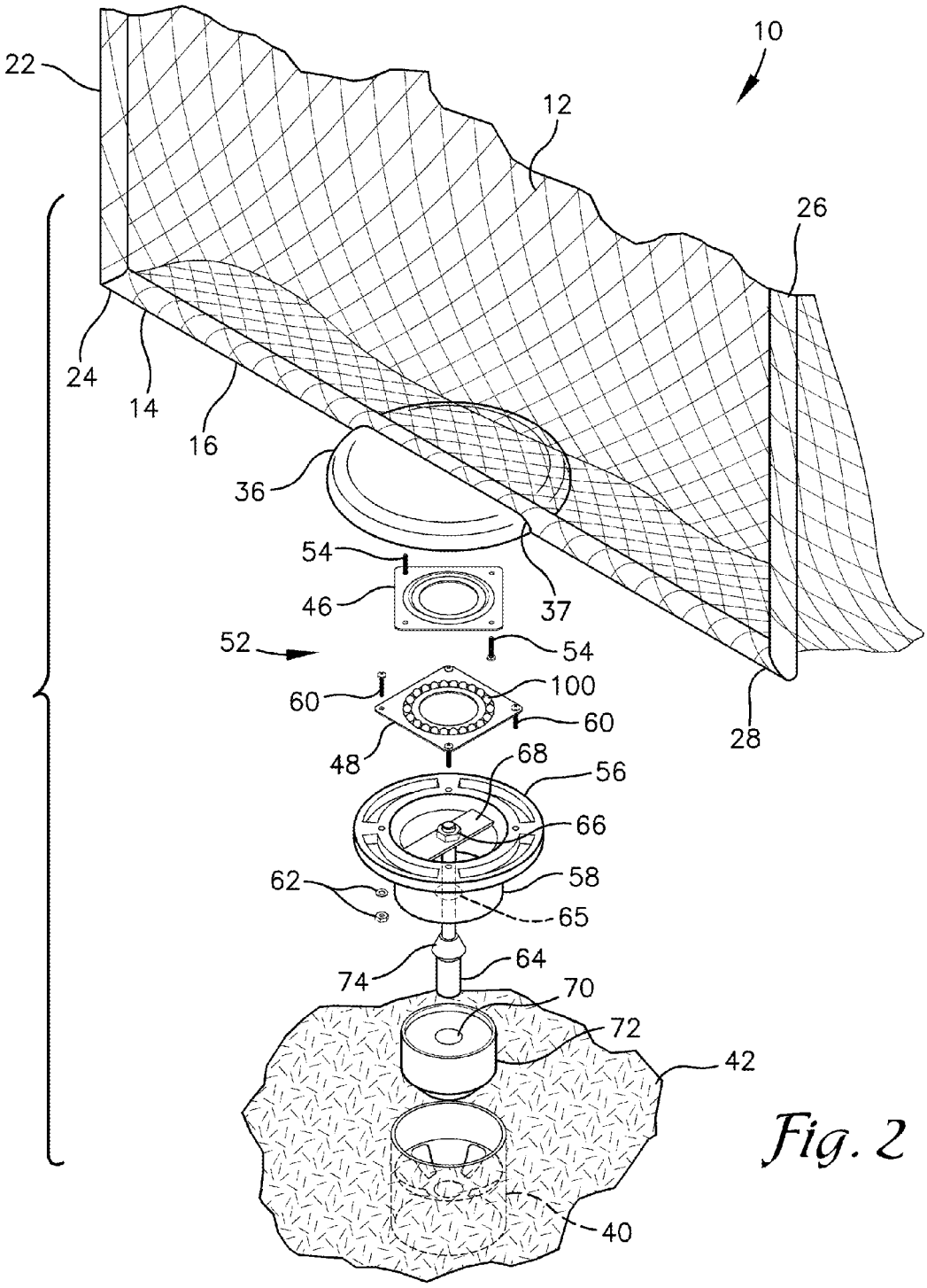
FIG. 2 is an exploded isometric view of the soccer goal of FIG. 1.

Referring to FIG. 2, the turntable 52 is attached to a bottom surface of the base 36. The turntable, 52 which is a conventional turntable known in the art, includes an upper turntable bearing race plate, or upper turntable member, 46, that is connected to the base 36 by the screws 54 and mates with and is attached to a lower turntable bearing race plate, or lower turntable member, 48, which carries the ball bearings 50. The bearing race plates 46, 48 are fastened together conventionally; and are not designed to be taken apart, that is, they are normally a single conventional assembly, or the turntable 52. The upper turntable bearing race plate 46 is attached to a lower surface of the base 36, which is preferably circular, by the screws 54.

The lower turntable bearing race plate 48 is fastened to a circular flange portion 56 of an upper hub member 58 by the screws 60 and corresponding nuts 62. A depending rod 64, which passes through the aperture 65 in the bottom of the upper hub member 58, is fastened to the upper hub member 58 by a nut 66 on a threaded upper end of the rod 64 that passes through an aperture in the brace member 68, which is fixed across an open upper surface inside the circular flange portion 56. The rod 64 extends into a central vertical bore 70 in the center of the lower hub member 72, which is shaped to conform to the shape of the golf cup 40. The rod 64 fits firmly into the central vertical bore 70, but can be removed from it so that a lower hub member 72 that is longer or shorter can be attached to it for use with golf cups of different depths. The firm fit of the rod 64 in the bore 70 ensures that the lower hub member 72 and the upper hub member 58 remain stationary relative to each other, while the soccer goal 10 is free to rotate by rotational movement of the upper turntable member 48. The lower hub member 72 is detachably connected to said upper hub member 58 by the rod 64 so that different sized lower hub member 72 can be used with the same soccer goal 10. The travel of the rod 64 into the central vertical bore 70 is stopped and limited by the conical collar 74, which serves as a stop. The hub assembly from the circular flange portion 56 down into the golf cup 40 is stationary, as the lower hub member 72 fits firmly into the golf cup 40, with the only rotation of the soccer goal 10 resulting from the rotation of the upper turntable bearing race plate 46 relative to the stationery lower turntable bearing race plate 48. The rod 64 may be omitted but its use improves the stability of the soccer goal 10. The lower hub member, for example, may have a circumferential lip that is press-fitted over a top edge of the upper hub member 58 with bearings between the upper and lower hub members, providing a sealed unit that is simply set into the golf cup 40. Other arrangements for allowing the soccer goal 10 to rotate can be designed. For example, vertically oriented roller bearings can be inserted between two nesting cup-shaped hub member that both fit into the golf cup, with one can, or bearing race, being rigidly attached the soccer goal 10. The only reason that the soccer goal 10 as disclosed includes a lower hub member 72 is that different golf cups of different sizes need different sizes of lower hub members, so it is desirable to have the ability to change the size of the portion of the hub that fits into the golf cup. If this is not a consideration, as may be the case in some instances, a single hub member having a depending portion that fits into a particular sized golf cup can be used.

Figure 3:
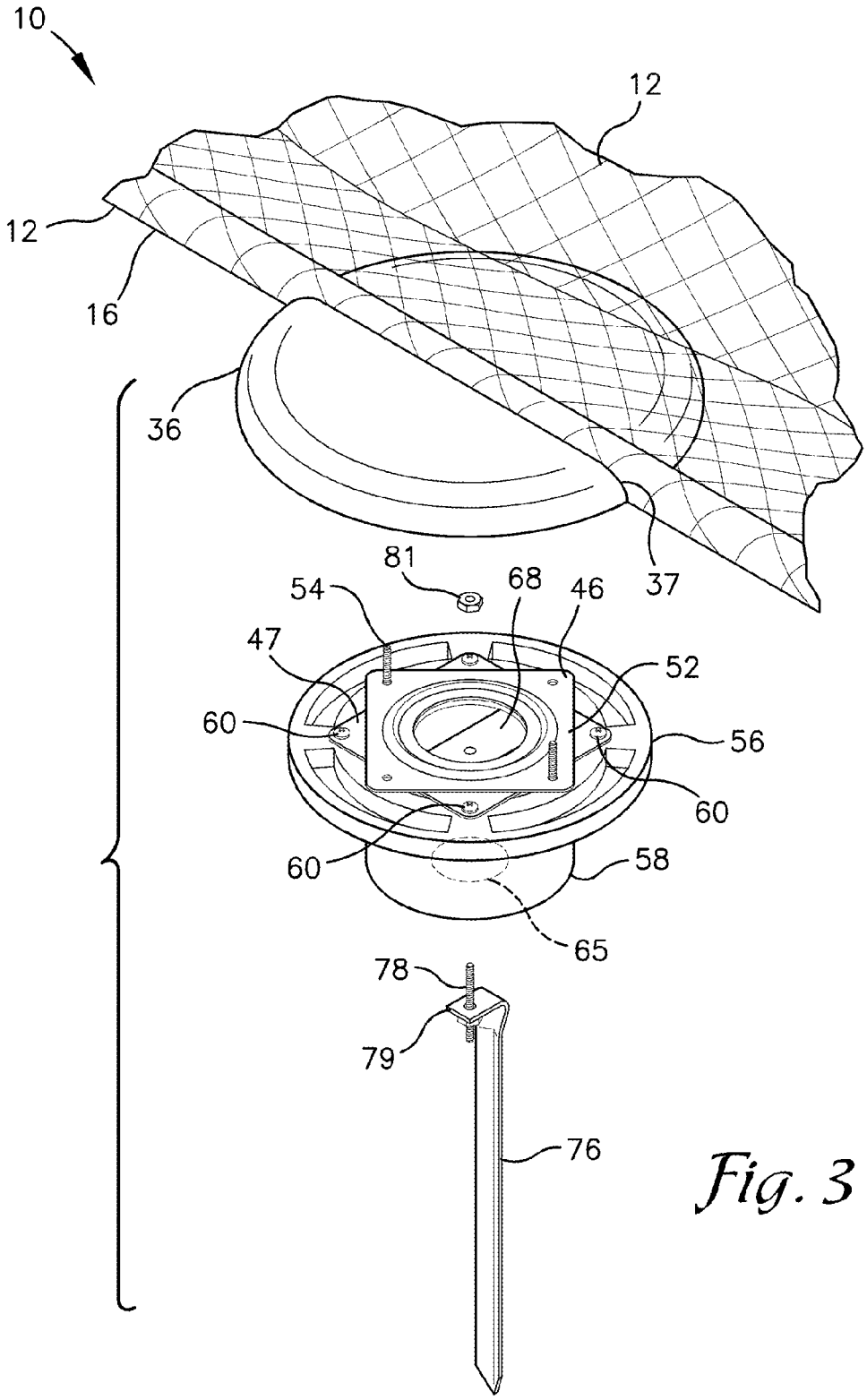
FIG. 3 is an enlarged fragmentary exploded isometric view of the rotating hub of the soccer goal of FIG. 1.

Referring to FIG. 3, an alternative embodiment of the soccer goal 10 omits the upper hub member 72 and the rod 64, which are replaced with the stake 76. The upper hub member 72 in this embodiment is designed to be seated in a golf cup 40, but if omitted, the stake 76 can be driven directly into the ground with the lower turntable member 48 resting on the ground. A plate or mat may be placed under the lower turntable 48. The stake 76 includes a perpendicular flange portion 79 at its top. A screw 78 is pushed through aligned apertures in the perpendicular flange portion 79 and the center of the horizontally disposed brace member 68. A nut 81 fixes the stake 76 to the upper hub member 58. The stake 76 is driven into the ground 42 by pressing on the base 36 or hitting it with a mallet. The bottom surface 80 of the upper hub member 58 is flattened so that it can rest firmly on the ground 52 and has an aperture through its bottom wall to accommodate the stake 76. Other approaches to holding the soccer goal 10 firmly against the ground include providing a plurality of small stakes or spikes permanently formed on the bottom surface upper hub member 58, providing threaded sockets on the bottom surface of the upper hub member 58 and screwing threaded spikes into those sockets and pressing the spikes into the ground, which is common with certain temporary baseball equipment. The soccer goal 10 will not generally be subjected to any significant lateral forces, unlike, for example, a baseball base, and so does not require a great deal of staking stabilization. The reduced size of the soccer goal 10 relative to a regulation soccer goal not only make it easier to transport and set up, but mimics a guarded regulation goal by making scoring a goal harder.

Figure 4:
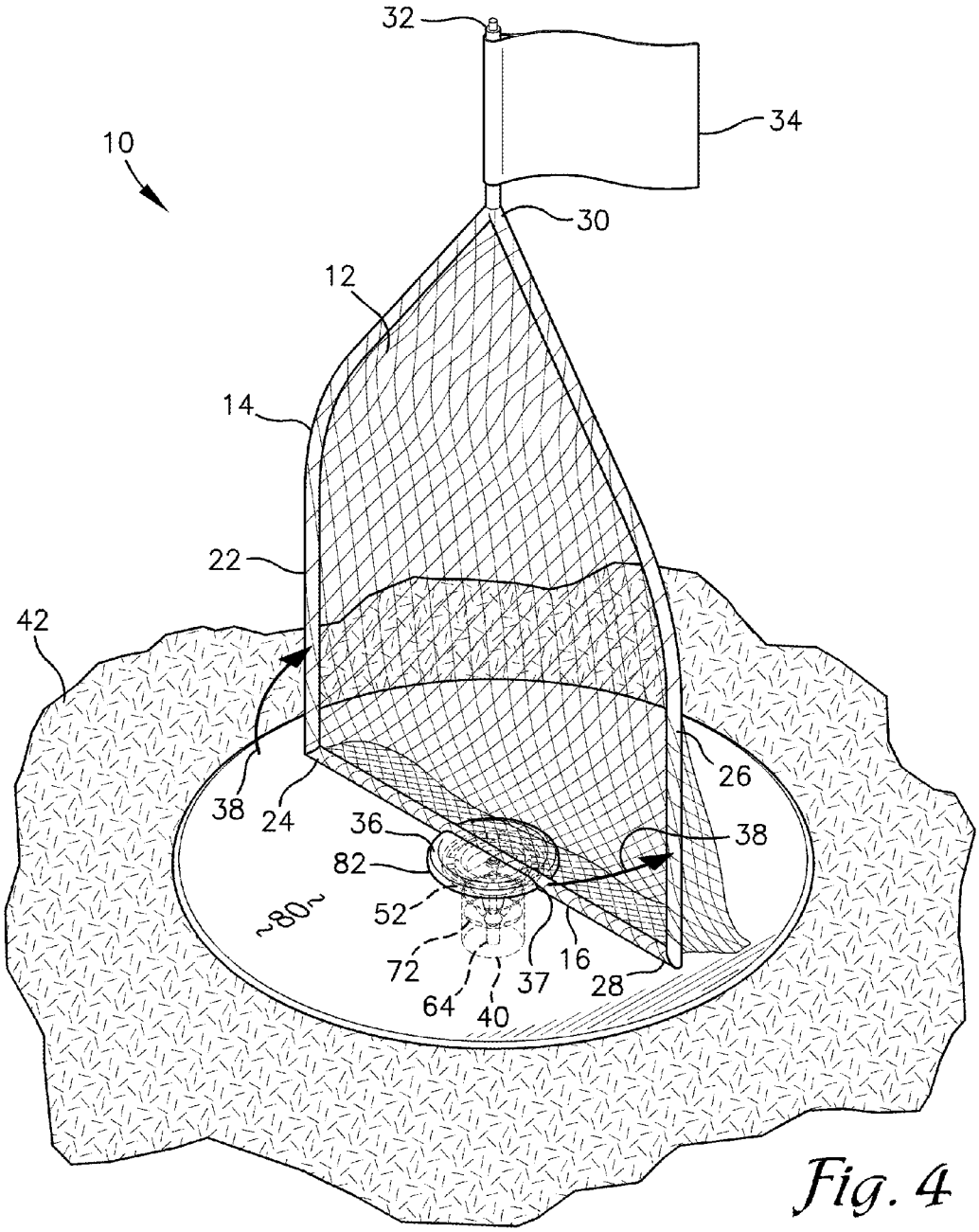
FIG. 4 is an isometric view of a the soccer goal of FIG. 1 shown with a ground leveling mat beneath the soccer goal, with the soccer goal mounted into an existing golf hole.

Referring to FIG. 4, a circular mat 80 having a circular hole 82 in its center is placed on the ground 52 before the lower hub member 72 of the soccer goal 10 is inserted into the golf cup 40. The circular hole 82 is slightly larger in diameter than the base 36. The circular mat 80 is relatively thick and heavy so that it will lie undisturbed in winds and is flexible so that it conforms to the lay of the land at the place where the soccer goal is placed. The ground level is sometimes uneven where the soccer goal is installed in a golf cup as in FIG. 4 or a field (without golf cups), as in FIG. 3, and the draping of the circular mat 80 from the circular hole 82 to fall and drape over and to substantially conform to contours of the terrain prevents gaps between the horizontal bar 16 and the ground 52 and is particular adapted for use when the ground slopes sharply away from the golf cup 52 or the ground where the soccer goal is placed on one side of the soccer goal, but on other sides or approaches. In such settings, use of the circular mat 80 prevents the soccer ball 18 taking an odd bounce and not going into the net 12 due to a gap between the bottom of the net 12, i.e., the horizontal bar 16 and the ground 52. The mat can be easily used with any particular embodiment of the soccer goal 10 and is flexible enough that it can be folded into a smaller shape for transporting from place to place.

Figure 5:
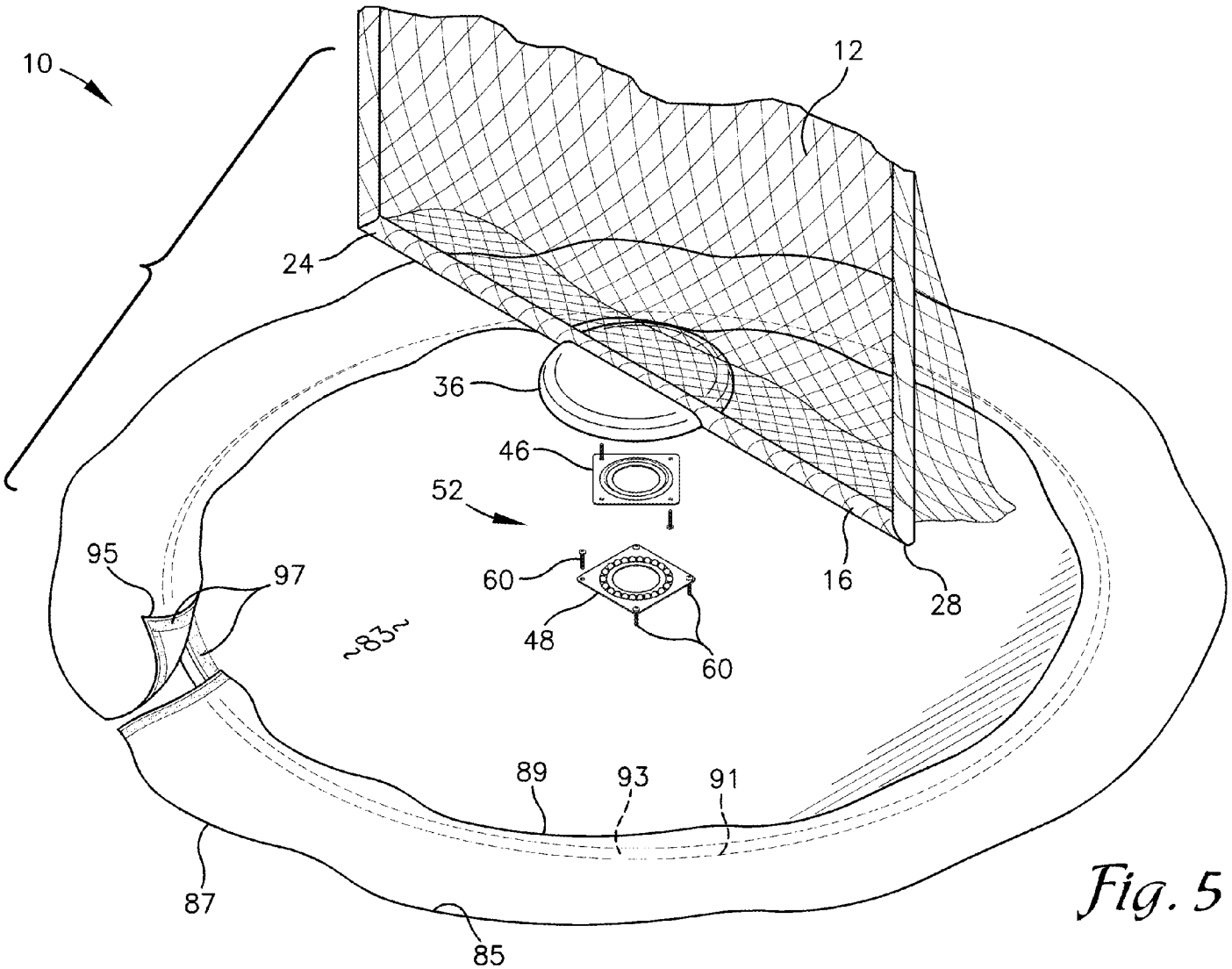
FIG. 5 is an isometric view of an alternative embodiment of the soccer goal according to the present invention that is adopted for use on the ground, without a golf hole, in which the soccer goal is mounted on a mat that is placed directly on the ground and that has a ground leveling skirt fastened to the perimeter of the mat.

Referring to FIG. 5, the alternative embodiment shown is designed to be placed flat on the ground, that is, no hole is needed. In this case, the base 36 of the soccer goal 10 has a lower surface that is fixed to the upper turntable member 46, which is, in turn fixed to the lower turntable member 48, with the upper and lower turntable members free to rotate relative one another. This is the same structure described in relation to FIG. 3, above. In this case, however, the lower turntable member 48 is fixed to a large mat 83, which may be any shape or size, but is preferably circular and is relatively heavy, preferably thicker and heavier that the mat 80 of FIG. 4, since the mat 83 must hold the soccer goal 10 upright in the face of winds and of impacts from a kicked soccer ball 18, or even players. In this connection reinforcing members or enlarged turntables to distribute forces over a larger surface area may be used. Sine the mat 83 is relatively heavy and thick, the lower turntable member 48 can be screwed directly into the mat by the screws 60, as shown. Alternatively, metal inserts with screw threads can be molded into the mat 83 and screws can be screwed into them, bolts penetrating aperture in the mat 83 can be secured by nuts with washers, bolts or the like can be inserted through apertures in the mat 83 and through aligned apertures in a reinforcing member, such as a square or circle underlying the mat 83. Any such reinforcing member can be permanently bonded to the mat 83. A quick-release mechanism can be used to permit the soccer goal 10 to be easily detached from the mat 83 and then reattached to it to make transporting this embodiment of the soccer goal 10 more convenient. In most applications, the mat 83 is about 1.2-2.4 m (4-8 feet) in diameter. A flexible skirt 85 is disposed about the perimeter of the mat 83. The skirt 85 is relatively thick and heavy, but flexible and deformable so that it conforms to the shape of the ground it rests upon and provides a thinner edge 87 to the soccer ball 18 and a gentle slope at a shallow angle up to the mat 83 so that travel of the soccer ball into the soccer goal is facilitated. The skirt 85 has an inside perimeter 89 that basically matches the perimeter 91 of the base 83. The skirt 85 overlaps the perimeter 91 of the base 36 and is fastened to it. The skirt 85 may be permanently attached by any know permanent fastening technique or may be detachably fastened to the base 83 by a hook and loop fastener system 97, snaps, or the like along the pathway 93. The skirt 85 is cut along the cut-line 95, which is perpendicular to the perimeter of the skirt 85 through the width of the skirt 85 so that it is easier to install an remove from the base 36. This embodiment can be deployed on any suitable open field in any desired placement or numbers without digging holes in the field or requiring preexisting holes.

Many different games and practice regimes can be played using the soccer goal 10. For example, referring to FIG. 1, a single player 44 may use the soccer goal located in a single location to practice his soccer ball kicking all alone. Or he may set up a progressive course, as in a golf course and keep a score. Any number of players can play a soccer golf game in which a different soccer goal 10 as shown in FIG. 10 is put into golf cups 44 along the golf course. Since golf course holes tend to be very far apart, it may also be desirable to place field stable soccer golf goals 10 as shown in FIG. 3 on the golf course, along fairways, for example, providing more soccer golf holes than golf holes and shortening the course for a given number of soccer goals. Players keep their own scores, which is the number of kicks needed to make a goal at each soccer goal 10. More than one player can play one ball, with, for example, two players or more comprising a team with each member kicking the soccer ball 18 ball in turns. When played as an imitation of golf, none of the soccer goals 10 is guarded. The person or team with the lowest score wins in this game.

Figure 6:
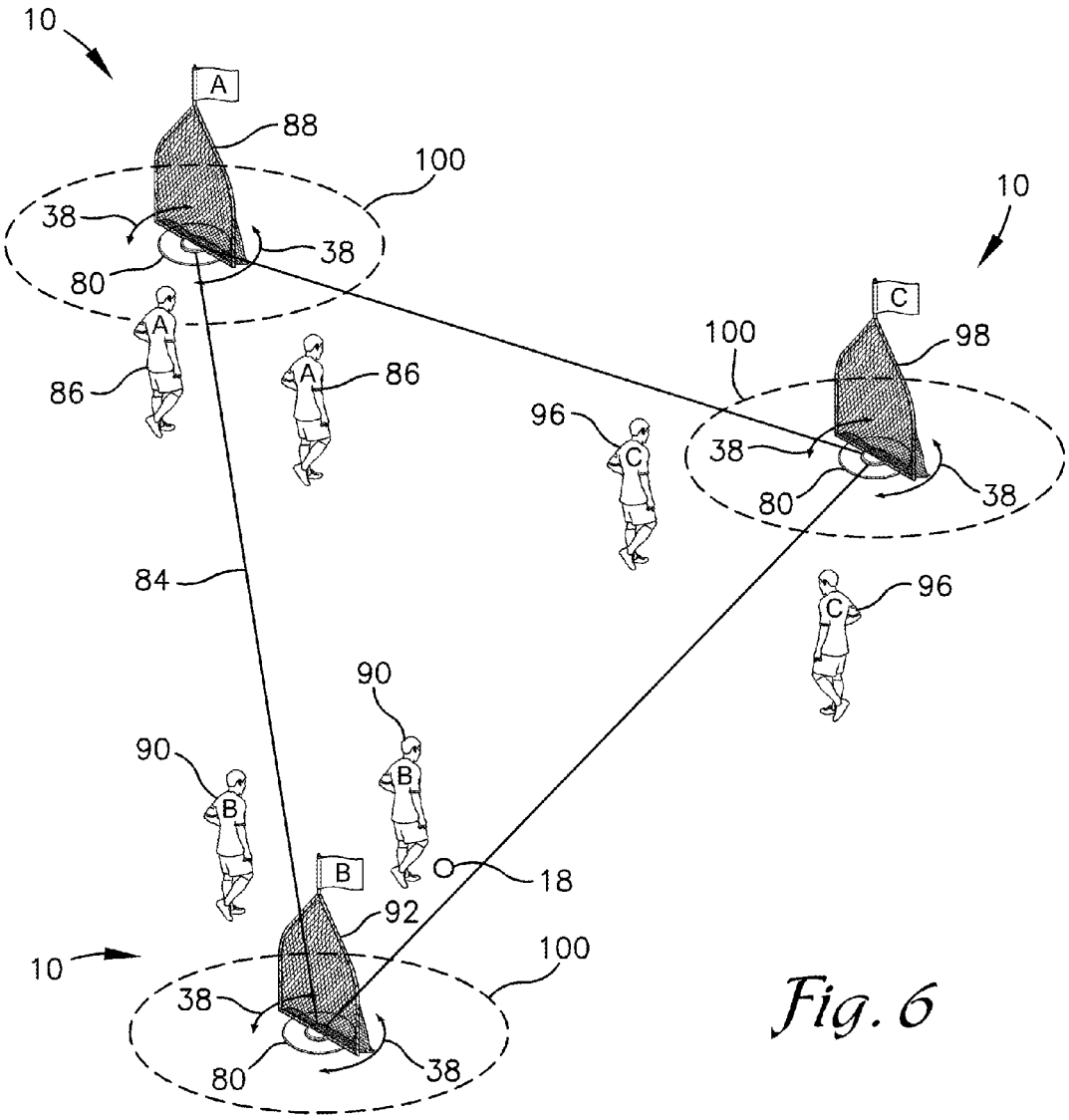
FIG. 6 is an isometric view of an arrangement of three of the soccer goals of FIG. 1 or FIG. 5 showing a new soccer-like game that can be played using the soccer goals of FIG. 1 or 5.

Referring to FIG. 6, three soccer goals 10 are set up, either in golf cup holes or on the ground 42, at the vertexes of a triangle 84. A separate team defends its own goal, so that Team A has players 86 defending the Team A soccer goal 88, Team B has players 90 defending the Team B soccer goal 92 and Team C 94 has players 96 defending the Team C soccer goal 98. Players can score a goal in either goal that is not the goal of the team they are representing. Each team can defend its Team goal if desired. Any kick from outside the two point line 100 is awarded an extra point, that is, is scored as two points, rewarding the greater difficulty of making a goal on a longer kick. The two point line 100, which is a circle and is preferably about 6 meters (20 feet) in diameter and concentric with the golf cup 40 or the hub lower hub member 72 (which will be at the same location when the soccer goal 10 is mounted in golf cup 40), may be drawn with chalk, powdered marble, temporary paint or the like, would allow the kicker to deduct two kicks from his score as a reward for the harder-to-make goals that are made from beyond this line. The two point line 100 can be employed in any variation of any game played using the soccer goal 10. For example, when scored like golf, one point can be deducted from the score when a player 44 scores a goal on a kick from outside the two point line 100, which may be drawn at any convenient distance from the soccer goal 10. One to five players 44 per team can play this match, which may be timed or may, by agreement terminate when one team has scored a specified number of goals, such as five, or ten or twenty. This game has the benefit of permitting a full-fledged soccer-like experience with many fewer players than a regulation soccer match, a more casual, perhaps pickup-natured game, while at the same time increasing the complexity of the game by permitting scoring from any direction relative to the center of each soccer goal 10 and the ability to score in more than one field. Play would be defended just as in traditional soccer, except that a defender's attention may be diverted by a second attacking team—not a possibility in regulation soccer and so added interest and competition are provided. Preferably only one soccer ball 18 is used, but each team may have its own ball, which is marked with a team designation, if desired.

In team play using more than one goal, in the arrangement shown in FIG. 6, the soccer goals 88, 92, 98 are preferably equidistant and at least twenty meters apart. The outside boundary, that is, the out-of-bounds lines, are preferably a minimum of fifteen meters from the nearest soccer goal 88, 92, 88, leading to a minimum field of an equilateral triangle that is sixty-two and one-half meter on each side. The two point boundary line for each soccer goal is ten meters from the center of each soccer goal 88, 92, 98. When using a single soccer goal 10, the field of play is preferably a square field having thirty meter sides. When two soccer goals 10 are used, the field of play is preferably a rectangle having a long dimension of fifty meters and a short side dimension of thirty meters. In all cases, the field is large enough to permit strategic play to develop for training and fun, but compact enough to permit play in unconventional spaces. These games can be played with teams having one player per team, or any desired number of players, so long as all teams have the same number of players. The games are preferably shorter than a formal soccer game and may conveniently comprise tow to minute halve separated by a half-time that is not longer than fifteen minutes. A goal is scored when the soccer ball 18 enters a soccer goal 10, or the goal of a particular team such as the soccer goal 88, 92, 98. The end of the game or match, the team with the mot goals is the winner. Matters such as substitution, uniforms, rules enforcement, use of referees, penalties and the like are in accord with conventional rules, unless the players otherwise agree, which will frequently be the case in casual games.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims. For example, many different mechanisms can be used to provide the function of the turntable, including article now known and others that may be developed later. Many different specific games can be devised, including for example, different sizes and shapes of playing fields, different numbers and layouts of goals and different numbers of teams can be devised. In all these games, however, the basic aspects of soccer—kicking a ball into a goal—has been preserved, making all uses of the soccer goal 10 a useful aid in having fun, exercising and developing soccer skills.

I claim:

1. A soccer goal comprising:

a. an upright frame having a horizontally disposed bottom member, said member having a left end, a right end, an upstanding left arm connected to said left end of said horizontally disposed bottom member and an upstanding right arm connected to said right end of said horizontally disposed bottom member and a net fastened to said frame;

b. a base connected to a center portion of said horizontally disposed bottom member;

c. a turntable connected to said base and said turntable further comprising an upper turntable member connected to a lower turntable member;

d. a mat placed on the ground about said soccer goal and connected to said lower turntable member whereby said soccer goal rotates when subjected to forces such as a kicked soccer ball and a soccer ball can enter said net regardless of the direction from which said soccer ball approaches said soccer goal; and e. a skirt detachably connected to a perimeter of said mat whereby said skirt provides a shallow low angle from the ground to the mat, whereby travel of the soccer ball into the soccer goal is facilitated.

2. A soccer goal in accordance with claim 1 wherein said frame lies in a plane.

3. A soccer goal in accordance with claim 1 wherein said upstanding left arm and said upstanding right arm each have an upper end and said upper ends are bent toward each other until said upper ends meet and said upper ends are fastened together.

4. A soccer goal in accordance with claim 1 wherein said net sags in said frame whereby when a soccer ball is kicked into said soccer goal, said net catches and retains said soccer ball.

5. A soccer goal comprising:

a. an upright frame having a horizontally disposed bottom member, said member having a left end, a right end, an upstanding left arm connected to said left end of said horizontally disposed bottom member and an upstanding right arm connected to said right end of said horizontally disposed bottom member and a net fastened to said frame;

b. a base connected to a center portion of said horizontally disposed bottom member;

c. a turntable connected to said base, said turntable further comprising an upper turntable member connected to a lower turntable member and an upper hub member fastened to said lower turntable member with said upper hub member seated in a lower hub member;

e. a vertical rod fastened to said upper hub member and an aligned bore through said lower hub member whereby said rod passes through said lower hub member, whereby said upper and lower hub members are held stationary relative to one another; and f. a flange portion attached to an upper surface of said upper hub member and said lower turntable member is attached to said flange portion.

6. A soccer goal in accordance with claim 5 further comprising a mat laid over a golf cup with said mat having an aperture that is placed above the golf cup and said soccer goal placed on said mat with said lower hub member seated in the golf cup.

7. A soccer goal in accordance with claim 5 further comprising a stop member fixed to said rod whereby travel of said rod through said bore in said lower hub member is limited.

8. A soccer goal in accordance with claim 5 further comprising a stake driven into the ground and then attached to said lower turntable member.

9. A soccer goal comprising:

a. an upright frame lying in a plane having a horizontally disposed bottom member, said member having a left end, a right end, an upstanding left arm connected to said left end of said horizontally disposed bottom member and an upstanding right arm connected to said right end of said horizontally disposed bottom member and a net fastened to said frame;

b. a base connected to a center portion of said horizontally disposed bottom member;

c. a turntable connected to said base;

d. a brace member horizontally disposed and connected to said lower turntable member, a stake driven into the ground and then attached to said lower turntable member and a horizontal flange portion of said stake whereby said horizontal flange member of said stake is removably attached to said brace member; and e. a stake driven into the ground and then attached to said lower turntable member.

* * * * *